US007400224B2

(12) United States Patent
Feist

(10) Patent No.: US 7,400,224 B2
(45) Date of Patent: Jul. 15, 2008

(54) DEVICE FOR ELECTRICAL ISOLATION, TOROIDAL CORE CHOKE, AND METHOD FOR PRODUCING THE TOROIDAL CORE CHOKE

(75) Inventor: Guenter Feist, Gingen/Fils (DE)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 11/732,717

(22) Filed: Apr. 4, 2007

(65) Prior Publication Data

US 2007/0241855 A1 Oct. 18, 2007

Related U.S. Application Data

(63) Continuation of application No. PCT/DE2005/001154, filed on Jun. 30, 2005.

(30) Foreign Application Priority Data

Oct. 7, 2004 (DE) ..... 10 2004 048 966

(51) Int. Cl.
*H01F 27/30* (2006.01)
*H01F 27/28* (2006.01)

(52) U.S. Cl. ..... 336/229; 336/206

(58) Field of Classification Search ..... 336/206, 336/229, 222

See application file for complete search history.

(56) References Cited

U.S. PATENT DOCUMENTS

| | | | |
|---|---|---|---|
| 6,690,257 | B2 | 2/2004 | Kobayashi et al. |
| 2002/0080001 | A1 | 6/2002 | Kobayashi et al. |
| 2006/0192649 | A1 | 8/2006 | Feth et al. |

FOREIGN PATENT DOCUMENTS

| | | | | |
|---|---|---|---|---|
| DE | 30 47 603 | A1 | | 7/1982 |
| DE | 199 32 475 | A1 | | 2/2001 |
| DE | 102 23 995 | C1 | | 11/2003 |
| DE | 103 08 010 | A1 | | 9/2004 |
| EP | 0 258 592 | A1 | | 3/1988 |
| EP | 1 220 242 | A1 | | 7/2002 |
| JP | 09045539 | A | * | 2/1997 |
| JP | 09237717 | A | * | 9/1997 |

* cited by examiner

*Primary Examiner*—Anh T Mai
(74) *Attorney, Agent, or Firm*—Slater & Matsil, L.L.P.

(57) ABSTRACT

A device for electrical isolation is suitable for installation in the core hole of a toroidal core. The device includes a center section that has a rotational axis, and branches that extend outwards and that are deformable in the rotational direction about the rotational axis. Each branch has an insulating region that preferably extends in the radial direction and that is thicker than the branches.

18 Claims, 2 Drawing Sheets

DEVICE FOR ELECTRICAL ISOLATION, TOROIDAL CORE CHOKE, AND METHOD FOR PRODUCING THE TOROIDAL CORE CHOKE

This application is a continuation of co-pending International Application No. PCT/DE2005/001154, filed Jun. 30, 2005, which designated the United States and was not published in English, and which is based on German Application No. 10 2004 048 966.1, filed Oct. 7, 2004, both of which applications are incorporated herein by reference.

TECHNICAL FIELD

The invention relates to a device for electrical isolation for a toroidal core choke with several windings.

BACKGROUND

An insulating part suitable for electrical isolation (or potential isolation) is known, for example, from the publication of German patent application DE 10223995 C1. The insulating part includes the toroidal core of a toroidal core choke and has projections for fixing wire windings and also for maintaining a grid dimension. The insulating part has branches, which provide the potential isolation, in the center region.

Another insulating part suitable for potential isolation is known, for example, from German patent application publication DE 10308010 A1. The insulating part has branches that extend outward in the radial direction and can be deformed elastically in the radial direction by pressure.

SUMMARY OF THE INVENTION

The task of the present invention is to specify a device for electrical isolation, which can be produced economically and which can be inserted into a toroidal core choke.

A device for electrical isolation is specified, which is suitable for installation in the core hole of a toroidal core. The device for electrical isolation includes a center section and branches that extend outward and that can be deformed elastically by rotating the center section, each of which has a rigid insulating region extending preferably in the radial direction on the end facing away from the center section and facing the toroidal core. The insulating region is preferably thicker relative to the branch allocated to it.

The device for electrical isolation preferably has a one-piece construction.

The potential isolating device can be inserted into the core hole of a toroidal core without a large expenditure of force. If the potential isolating device is screwed into the core hole, it springs back until it is clamped in the core hole. In this way, the electrical isolation device is prevented from falling out of the toroidal core choke. The elastic flexibility of the electrical isolation device allows for compensation, in particular, of the tolerances in the construction of the core hole.

The deformable branches represent thin-wall spring elements, which are bent into the core hole when the electrical isolation device is screwed in, whereby the insulating regions are pulled back toward the center, with the diameter of the electrical isolation device being reduced.

All plastics, which are preferably heat-resistant or fireproof, are suitable as the material for the electrical isolation device.

A device for non-positive connection of a work arbor is preferably provided on the center section. In one variant, this device represents a pocket recess formed in the center section and directed along the rotational axis for accommodating the work arbor. Instead of a pocket recess, an opening directed along the rotational axis can also be provided for accommodation of the work arbor.

The device for non-positive attachment of a work arbor can alternatively have several recesses constructed on the center section and oriented parallel to the rotational axis for accommodation of several work arbors.

On the center section of the electrical isolation device, pockets can be formed, with the outer wall of one pocket preferably forming a part of a deformable branch. The pockets preferably run in the rotational plane at an angle to the radial direction or essentially in the circumferential direction.

The insulating regions can each have projections for engaging the toroidal core that prevents the sliding of the electrical isolation device in the longitudinal direction (parallel to the rotational axis). These projections are preferably provided on both ends of each insulating region (in the view in the longitudinal direction), with a deeper section, formed in the insulating region where the toroidal core can be arranged.

The insulating regions preferably run essentially in the radial direction. The deformable branches are each preferably angled away from the associated insulating region in the unclamped state. The angle can equal ca. 24°, e.g., for three branches.

The device for electrical isolation can be inserted into a toroidal core choke with the toroidal core and several windings to be separated from each other, with the number of insulating regions being equal to the number of windings. The deformable branches are clamped in the rotational direction after being inserted into the core hole and exert an elastic force on the insulating regions acting in the direction of the toroidal core. Here, the insulating regions are each pressed against the inner wall of the toroidal core.

The diameter of the device for electrical isolation in an unclamped state is greater than the inner diameter of the toroidal core. In a preferred variant, the winding of the toroidal core choke forms the counter bearing for the unwinding of the branches around the center section, with the insulating regions each contacting one winding (lying closest in the circumferential direction).

The invention further relates to a method for producing a toroidal core choke with electrical isolation. The device for electrical isolation is turned about a rotational axis outside the core hole until the insulating regions stop against the windings of the toroidal core choke in the rotational direction. The center section is turned further, relative to the stationary insulating regions, with the deformable branches being deformed and the diameter of the device for electrical isolation being reduced. The device for electrical isolation is inserted into the core hole of the toroidal core, as soon as the diameter of the device for electrical isolation falls below the inner diameter of the toroidal core. The device for electrical isolation springs back until it is clamped in the core hole.

In one variant, the center section is set on a work arbor and is driven with a non-positive fit by rotation by means of the work arbor.

When the electrical isolation device is screwed into the core hole, the radial alignment of the insulating regions is essentially maintained in each position.

BRIEF DESCRIPTION OF THE DRAWINGS

Below, the invention is explained in more detail with reference to embodiments and the associated figures. The figures show various embodiments of the invention with reference to schematic representations that are not true to scale. Parts that are identical or that have the identical function are designated with identical reference symbols. Shown schematically are.

DETAILED DESCRIPTION OF ILLUSTRATIVE EMBODIMENTS

Figure 1A:
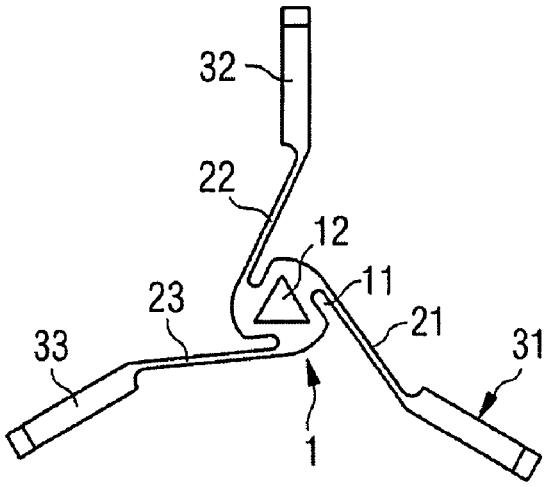
FIG. 1A, a view of a device for electrical isolation from above.

FIG. 1A shows a device for electrical isolation, which has a center section 1 with a centrally arranged opening 12 for accommodating a guiding element of an external turning device. The device for electrical isolation further has three insulating regions 31, 32, 33, each connected rigidly to the center section 1 by means of thin-wall branches 21, 22, 23. The device for electrical isolation here has a one-piece construction.

Each branch 21 to 23 represents a thin wall, which is aligned parallel to the rotational axis. Because the branches 21 to 23 have a thin-wall construction, they are easily deformable in a direction lying in the plane, the plane of rotation, running perpendicular to the branch wall.

The insulating regions 31 to 33 are each aligned in the radial direction. In contrast, the branches run at an angle relative to the radial direction or relative to the associated insulating region, with each branch 21 to 23 running in a straight line in the unclamped state connecting the insulating region 31 to 33 allocated to it and the center section 1 "diagonally." Therefore, relative to the alignment in the radial direction, a greater connecting-piece length is achieved, which increases the flexibility of the branch. Pockets 11, which are used for further lengthening of each branch, are formed in the center section 1 on the shoulder of each branch.

The opening 12 here has a prism shape or has a triangular cross section and is directed along the rotational axis. The opening or blind pocket recess corresponding to this opening can have a different cross section, which is suitable for guiding (by rotation) the center section 1 through an outer turning device. The rotational force is transferred, preferably with a positive fit, from the turning device to the center section 1. The construction of the opening 12 with (in cross section) at least three corner points is especially advantageous here. It is also possible, however, to construct the opening 12 with axes of different lengths in the plane of rotation (e.g., as an ellipse or rectangle). The guiding element of the turning device can, but does not have to, be arranged with a positive fit in the opening 12.

An advantageous device for electrical isolation is one in which the insulating regions or branches always have the same angle 360°/n, for three branches 120°, relative to each other, with $n \geqq 2$ being the number of insulating regions or branches.

The thickness of the branches can equal, e.g., between 0.5 mm and 1 mm according to the diameter of the provided core hole. The thickness of the branches selected can also be smaller than 0.5 mm or greater than 1 mm according to the construction. The connecting-piece length is preferably at least five times greater than the thickness. The thickness of the insulating regions is preferably not below the value of 2 mm.

The height of the electrical isolation device is set according to the height of the toroidal core in which the electrical isolation device is to be fixed.

Figure 1B:
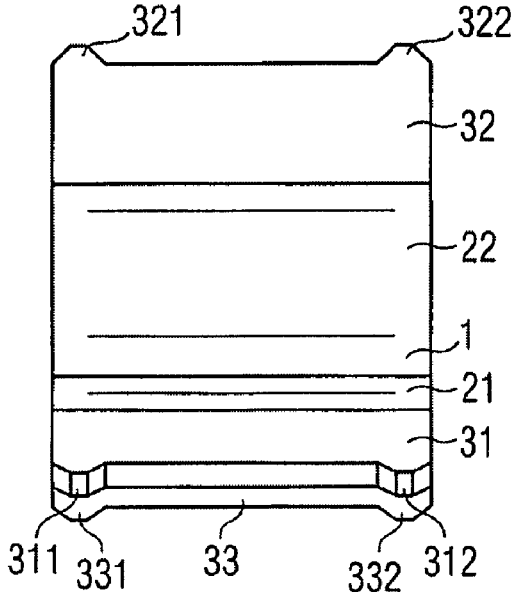
FIG. 1B, a view of the device for electrical isolation according to FIG. 1A from the side.

In FIG. 1B, a schematic side view of the device shown in FIG. 1A is presented. The length of the electrical isolation device in a longitudinal direction running parallel to the rotational axis, in this variant, exceeds the provided height of the toroidal core. In the end regions of insulating regions 31, 32, 33, projections 311, 312, 321, 322, or 331, 332 are formed at different heights in the longitudinal direction. The toroidal core of the toroidal core choke can be fixed between these projections.

The length of the electrical isolation device in the longitudinal direction can be less than or equal to the height of the toroidal core provided in another variant. In this case, the fixing projections 311, 312, 321, 322 can even be eliminated. In one variant, the projections 311, 312, 321, 322 can be pressed against the inner wall of the toroidal core and can thus fix the electrical isolation device in the core hole.

Figure 1C:
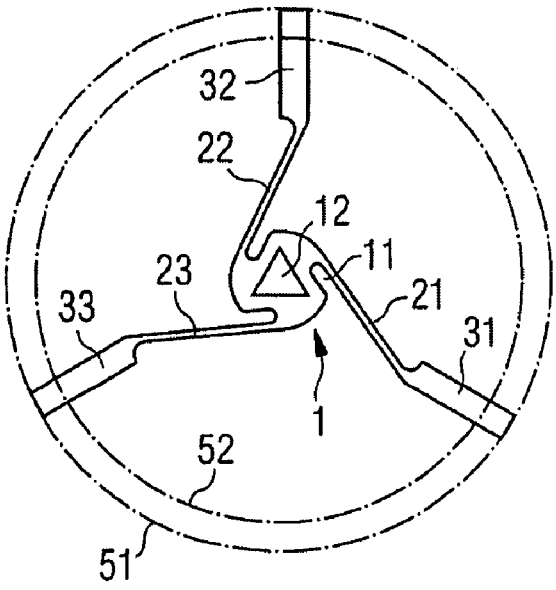
FIG. 1C, the device for electrical isolation in an unclamped state before being inserted into the core hole.

In FIG. 1C, the electrical isolation device is shown in an unclamped state or before insertion into the core hole, with the diameter 51 of a circle enclosing the unclamped electrical isolation device being greater than the diameter 52 of the core hole. The branches 21 to 23 run in a straight line.

Figure 1D:
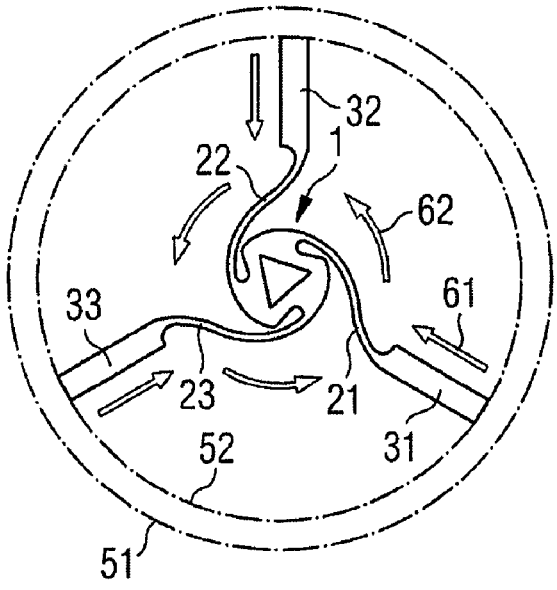
FIG. 1D, the device for electrical isolation in a clamped state during or after the insertion in the core hole.

In FIG. 1D, the electrical isolation device is shown in a clamped state or after insertion in the core hole, with the diameter of a circle enclosing the clamped electrical isolation device equaling the diameter 52 of the core hole. The offset direction 61 of the insulating regions 31 to 33 and the rotational direction 62 are shown with arrows.

Figure 2:
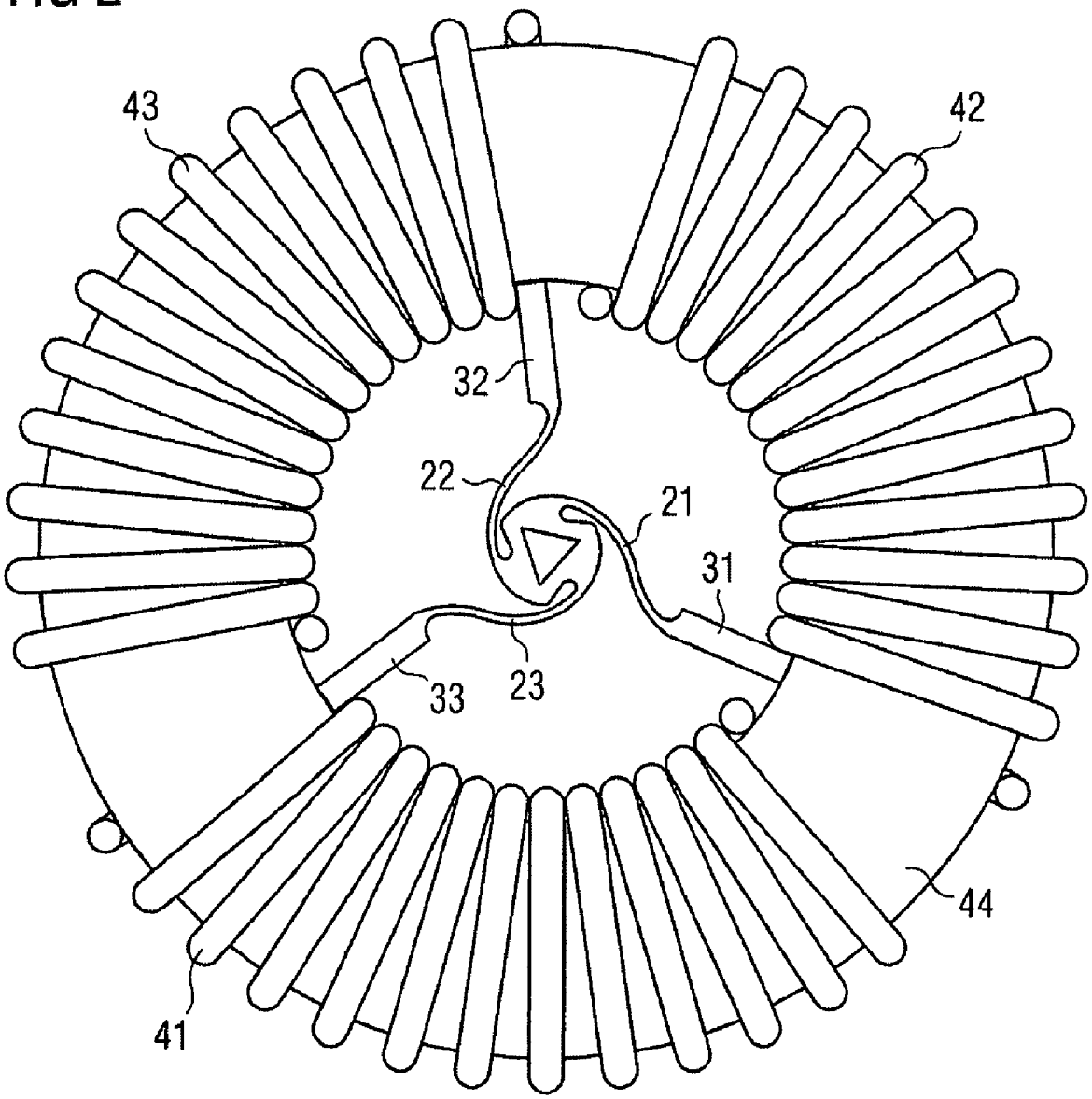
FIG. 2, a toroidal core choke with a device inserted in the core hole for electrical isolation.

The insulating regions 31 to 33 are held tight in the rotation of the center section 1 preferably by a wire winding (see FIG. 2, which shows windings 41, 42, 43), which deforms the branches 21 to 23. By deforming a branch, e.g., the branch 21, the corresponding insulating region 31 is pushed toward the center of the device. The offset direction 61 of the insulating regions 31 to 33 here corresponds to a radial direction.

As soon as the diameter of the electrical isolation device reaches the diameter of the core hole, the electrical isolation device is pushed into the core hole. The branches 21 to 23 here remain in a clamped state and exert an elastic force, which acts against the toroidal core in the radial direction and thus fixes the electrical isolation device in the core hole, on the insulating regions 31 to 33.

The invention is not limited to the embodiments illustrated in the figures, especially to the shape or the number of the shown elements. An arbitrary number of branches or insulating regions is possible.

What is claimed is:

1. A device for electrical isolation for installation in the core hole of a toroidal core, comprising:

a center section; and at least two branches that extend outwardly from the center section, are elastically deformable, and that can be wound around the center section, each of the branches having a rigid insulating region on the end facing away from the center section.

2. The device according to claim 1, further comprising a device constructed at the center section for a non-positive connection of a work arbor.

3. The device according to claim 2, wherein the device for non-positive connection of a work arbor is constructed as a recess in the center section and is directed along a rotational axis.

4. The device according to claim 2, wherein the device for non-positive connection of a work arbor is constructed as an opening in the center section and directed along a rotational axis.

5. The device according to claim 1, further comprising pockets constructed at the center section, wherein an outer wall of each pocket is formed by a part of one of the branches.

6. The device according to claim 5, wherein the pockets extend in the plane of rotation essentially in a circumferential direction.

7. The device according to claim 1, wherein the insulating regions each have projections for engaging the toroidal core in the device for electrical isolation.

8. The device according to claim 1, wherein the insulating regions extend essentially in a radial direction.

9. The device according to claim 1, wherein the deformable branches are angled relative to the correspondingly allocated insulating region.

10. The device according to claim 1, where the center part and the at least two branches are parts of a one-piece construction.

11. A toroidal core choke comprising:

a toroidal core;

a plurality of windings wound around the toroidal core; and an isolation device isolating the windings from each other, the isolation device comprising a center section and at least two branches that extend outwardly from the center section, the branches wound around the center section so as to electrically isolate the windings from each other, each of the branches having a rigid insulating region on the end facing away from the center section.

12. The toroidal core choke according to claim 11, wherein the branches are clamped by winding around the center section and in this way exert an elastic force, which acts in a radial direction, on the insulating regions.

13. The toroidal core choke according to claim 11, wherein the insulating regions each contact one of the windings.

14. The toroidal core choke according to claim 11, wherein the plurality of windings include exactly three windings and wherein the at least two branches include exactly three branches, each of the branches arranged between two of the windings.

15. The toroidal core choke according to claim 14, wherein the insulating region of each branch physically contacts one of the two windings between which the branch is arranged.

16. The toroidal core choke according to claim 11, wherein a diameter of the isolation device in an unclamped state is greater than an inner diameter of the toroidal core.

17. A method for producing a toroidal core choke, the method comprising:

providing a toroidal core having a plurality of windings wound around the core;

providing an isolation device that comprises a center section and at least two branches that extend outwardly from the center section, each of the branches being elastically deformable and having a rigid insulating region on an end facing away from the center section;

turning the isolation device about a rotational axis outside a core hole of the toroidal core until the insulating regions stop against the windings in a rotational direction;

turning the center section further relative to the insulating regions, wherein the deformable branches are deformed and a diameter of the isolation device is reduced;

inserting the isolation device into the core hole of the toroidal core after the diameter of the device for electrical isolation falls below an inner diameter of the toroidal core; and allowing the isolation device to spring back within the core hole.

18. The method according to claim 17, wherein the center section is set on a turning device and is driven to rotate by means of the turning device.

* * * * *